US009802087B2

(12) United States Patent
Schweigert et al.

(10) Patent No.: US 9,802,087 B2
(45) **Date of Patent: *Oct. 31, 2017**

(54) GOLF CLUB HEADS AND METHODS TO MANUFACTURE GOLF CLUB HEADS

(71) Applicant: Parsons Xtreme Golf, LLC, Scottsdale, AZ (US)

(72) Inventors: Bradley D. Schweigert, Scottsdale, AZ (US); Michael R. Nicolette, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/377,120

(22) Filed: Dec. 13, 2016

(65) Prior Publication Data

US 2017/0087427 A1 Mar. 30, 2017

Related U.S. Application Data

(63) Continuation of application No. 14/939,849, filed on Nov. 12, 2015, now Pat. No. 9,555,295, which is a continuation of application No. 14/615,606, filed on Feb. 6, 2015, now Pat. No. 9,199,140.

(51) Int. Cl.
*A63B 53/04* (2015.01)
*A63B 60/02* (2015.01)

(52) U.S. Cl.
CPC ..... *A63B 53/0466* (2013.01); *A63B 53/04* (2013.01); *A63B 60/02* (2015.10); *A63B 2053/0408* (2013.01); *A63B 2053/0412* (2013.01); *A63B 2053/0433* (2013.01); *A63B 2053/0491* (2013.01)

(58) Field of Classification Search
CPC ..... A63B 53/0466; A63B 53/04; A63B 2053/0408; A63B 2053/0412; A63B 2053/0433; A63B 2053/0491
USPC ..... 473/334–339, 341, 344, 345
See application file for complete search history.

(56) References Cited

U.S. PATENT DOCUMENTS

| | | | |
|---|---|---|---|
| 1,133,129 | A | 3/1915 | Govan |
| 1,269,745 | A | 6/1918 | Robertson |
| 1,306,029 | A | 6/1919 | Robertson |
| D55,867 | S | 7/1920 | Mattern |
| 1,534,600 | A | 4/1925 | Mattern |
| 1,538,312 | A | 5/1925 | Beat |

(Continued)

OTHER PUBLICATIONS

International Search Report and Written Opinion received in connection with corresponding application No. PCT/US2015/016666, dated May 14, 2015 (8 pages).

(Continued)

*Primary Examiner* — Benjamin Layno

(57) ABSTRACT

Embodiments of golf club heads and methods to manufacture golf club heads are generally described herein. In one example, a golf club head may include a body portion and a plurality of weight portions. The plurality of weight portions may include a first set of weight portions and a second set of weight portions. Each weight portion of the first set of weight portions may be associated with a first mass, and each weight portion of the second set of weight portions may be associated with a second mass that is less than the first mass. Other examples and embodiments may be described and claimed.

20 Claims, 10 Drawing Sheets

(56) References Cited

U.S. PATENT DOCUMENTS

D138,437 S 8/1944 Link
D138,438 S 8/1944 Link
D138,442 S 8/1944 Link
3,652,094 A 3/1972 Glover
D240,748 S 7/1976 Bock
4,085,934 A 4/1978 Churchward
D253,778 S 12/1979 Madison
D307,783 S 5/1990 Linuma
D326,885 S 6/1992 Paul
D351,883 S 10/1994 Solheim et al.
5,518,243 A 5/1996 Redman
D378,111 S 2/1997 Parente et al.
D384,120 S 9/1997 De La Cruz et al.
5,788,584 A 8/1998 Parente et al.
D400,625 S 11/1998 Kubica et al.
D400,627 S 11/1998 Kubica et al.
D405,489 S 2/1999 Kubica et al.
D405,492 S 2/1999 Kubica et al.
5,997,415 A 12/1999 Wood
D444,830 S 7/2001 Kubica et al.
6,290,609 B1 9/2001 Takeda
6,306,048 B1 10/2001 McCabe et al.
6,409,612 B1 6/2002 Evans et al.
D478,140 S 8/2003 Burrows
6,638,182 B2 10/2003 Kosmatka
6,773,360 B2 8/2004 Willett et al.
D508,969 S 8/2005 Hasebe
D513,051 S 12/2005 Barez et al.
D514,179 S 1/2006 Chen et al.
D514,185 S 1/2006 Barez et al.
D520,586 S 5/2006 Bingman
D522,077 S 5/2006 Schweigert et al.
D522,601 S 6/2006 Schweigert et al.
D523,498 S 6/2006 Chen et al.
D526,694 S 8/2006 Schweigert et al.
7,083,530 B2 8/2006 Wahl et al.
7,121,956 B2 10/2006 Lo
D534,599 S 1/2007 Barez et al.
7,166,040 B2 1/2007 Hoffman et al.
D536,401 S 2/2007 Kawami
D536,403 S 2/2007 Kawami
D536,498 S 2/2007 Presnell
7,186,190 B1 3/2007 Beach et al.
7,223,180 B2 5/2007 Willett et al.
D564,054 S 3/2008 Jertson et al.
D564,055 S 3/2008 Jertson et al.
7,338,388 B2 3/2008 Schweigert et al.
7,347,794 B2 3/2008 Schweigert
D566,934 S 4/2008 Della Valle
D567,317 S 4/2008 Jertson et al.
D569,933 S 5/2008 Jertson et al.
D569,935 S 5/2008 Jertson et al.
D569,936 S 5/2008 Jertson et al.
D569,942 S 5/2008 Jertson et al.
D570,937 S 6/2008 Schweigert et al.
D570,938 S 6/2008 Jertson et al.
7,407,447 B2 8/2008 Beach et al.
7,410,425 B2 8/2008 Willett et al.
7,410,426 B2 8/2008 Willett et al.
7,419,441 B2 9/2008 Hoffman et al.
7,448,963 B2 11/2008 Beach et al.
7,448,964 B2 11/2008 Schweigert et al.
7,530,904 B2 5/2009 Beach et al.
D594,520 S 6/2009 Schweigert et al.
D594,521 S 6/2009 Jertson et al.
D594,919 S 6/2009 Schweigert et al.
7,540,811 B2 6/2009 Beach et al.
D597,620 S 8/2009 Taylor et al.
7,568,985 B2 8/2009 Beach et al.
7,578,753 B2 8/2009 Beach et al.
D600,297 S 9/2009 Jertson et al.
7,584,531 B2 9/2009 Schweigert et al.
7,588,502 B2 9/2009 Nishino
7,591,738 B2 9/2009 Beach et al.
D603,472 S 11/2009 Schweigert et al.
7,611,424 B2 11/2009 Nagai et al.
7,621,823 B2 11/2009 Beach et al.
D605,715 S 12/2009 Barez et al.
7,632,194 B2 12/2009 Beach et al.
7,658,686 B2 2/2010 Soracco
7,713,142 B2 5/2010 Hoffamn et al.
7,717,804 B2 5/2010 Beach et al.
7,717,805 B2 5/2010 Beach et al.
D618,746 S 6/2010 Jertson et al.
D618,747 S 6/2010 Schweigert et al.
D618,753 S 6/2010 Jertson et al.
D618,754 S 6/2010 Schweigert et al.
7,744,484 B1 6/2010 Chao
7,798,203 B2 9/2010 Schweigert et al.
7,846,041 B2 12/2010 Beach et al.
D635,626 S 4/2011 Nicolette
7,927,229 B2 4/2011 Jertson et al.
D638,893 S 5/2011 Schweigert et al.
D638,896 S 5/2011 Schweigert et al.
7,963,861 B2 6/2011 Beach et al.
8,012,038 B1 9/2011 Beach et al.
D647,585 S 10/2011 Jertson et al.
D661,751 S 6/2012 Nicolette et al.
D661,756 S 6/2012 Nicolette et al.
8,257,196 B1 9/2012 Abbott et al.
8,257,197 B2 9/2012 Schweigert
8,262,506 B2 9/2012 Watson et al.
D673,630 S 1/2013 Schweigert
D673,632 S 1/2013 Schweigert et al.
8,371,957 B2 2/2013 Schweigert et al.
D680,179 S 4/2013 Solheim et al.
8,414,422 B2 4/2013 Peralta et al.
8,485,919 B2 7/2013 Rice et al.
D691,230 S 10/2013 Chen et al.
8,562,457 B2 10/2013 Beach et al.
8,608,587 B2 12/2013 Henrikson et al.
8,628,431 B2 1/2014 Schweigert et al.
8,651,975 B2 2/2014 Soracco
8,663,026 B2 3/2014 Blowers et al.
8,777,778 B2 7/2014 Solheim et al.
8,784,232 B2 7/2014 Jertson et al.
8,790,196 B2 7/2014 Solheim et al.
8,808,108 B2 8/2014 Schweigert
D712,989 S 9/2014 Gillig
8,826,512 B2 9/2014 Schweigert
8,858,362 B1 10/2014 Leposky et al.
8,961,336 B1 2/2015 Parsons et al.
D724,164 S 3/2015 Schweigert et al.
D729,892 S 5/2015 Nicolette et al.
D733,234 S 6/2015 Nicolette
9,199,140 B1 12/2015 Schweigert et al.
9,199,143 B1 12/2015 Parsons et al.
D753,251 S 4/2016 Schweigert et al.
D756,471 S 5/2016 Nicolette et al.
9,352,197 B2 5/2016 Parsons et al.
D760,334 S 6/2016 Schweigert et al.
9,399,352 B2 7/2016 Parsons et al.
9,427,634 B2 8/2016 Parsons et al.
9,555,295 B2 * 1/2017 Schweigert ..... A63B 53/0466
2003/0104878 A1 6/2003 Yabu
2004/0033846 A1 2/2004 Caldwell
2006/0105856 A1 5/2006 Lo
2006/0111200 A1 5/2006 Poynor
2007/0293344 A1 12/2007 Davis
2008/0004133 A1 1/2008 Schweigert
2008/0188322 A1 8/2008 Anderson et al.
2009/0029795 A1 1/2009 Schweigert et al.
2010/0144461 A1 6/2010 Ban
2010/0331102 A1 12/2010 Golden et al.
2011/0143858 A1 6/2011 Peralta et al.
2012/0202615 A1 8/2012 Beach et al.
2012/0220387 A1 8/2012 Beach et al.
2013/0303304 A1 11/2013 Sato

(56) References Cited

U.S. PATENT DOCUMENTS

| | | | |
|---|---|---|---|
| 2013/0318772 | A1 | 12/2013 | Wahl et al. |
| 2015/0231454 | A1 | 8/2015 | Parsons et al. |

OTHER PUBLICATIONS

International Search Report and Written Opinion received in connection with PCT/US15/42484 dated Oct. 19, 2015 (12 pages).
International Search Report and Written Opinion received in connection with PCT Application PCTUS2015042282 dated Oct. 13, 2015 (12 pages).
U.S. Appl. No. 29/512,313, Nicolette, "Golf Club Head," filed Dec. 18, 2014, cited by applicant.
Wall, Jonathan, "Details: Phil's Prototype Mack Daddy PM-Grind Wedge," (http://www.pgatour.com/equipmentreport/2015/01/21/callaway-wedge.html), www.pgatour.com, PGA Tour, Inc., published Jan. 21, 2015, cited by applicant.
International Search Report and Written Opinion received in connection with PCT/US16/17474 dated May 12, 2016 (8 pages).

* cited by examiner

GOLF CLUB HEADS AND METHODS TO MANUFACTURE GOLF CLUB HEADS

CROSS REFERENCE

This application is a continuation of U.S. patent application Ser. No. 14/939,849, filed Nov. 12, 2015, now U.S. Pat. No. 9,555,295, which is a continuation application of U.S. patent application Ser. No. 14/615,606, filed Feb. 6, 2015, now U.S. Pat. No. 9,199,140. The disclosures of the referenced applications are incorporated herein by reference.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to sports equipment, and more particularly, to golf club heads and methods to manufacture golf club heads.

BACKGROUND

In golf, various factors may affect the distance and direction that a golf ball may travel. In particular, the center of gravity (CG) and/or the moment of inertia (MOI) of a golf club head may affect the launch angle, the spin rate, and the direction of the golf ball at impact. Such factors may vary significantly based the type of golf swing.

Figure 1:
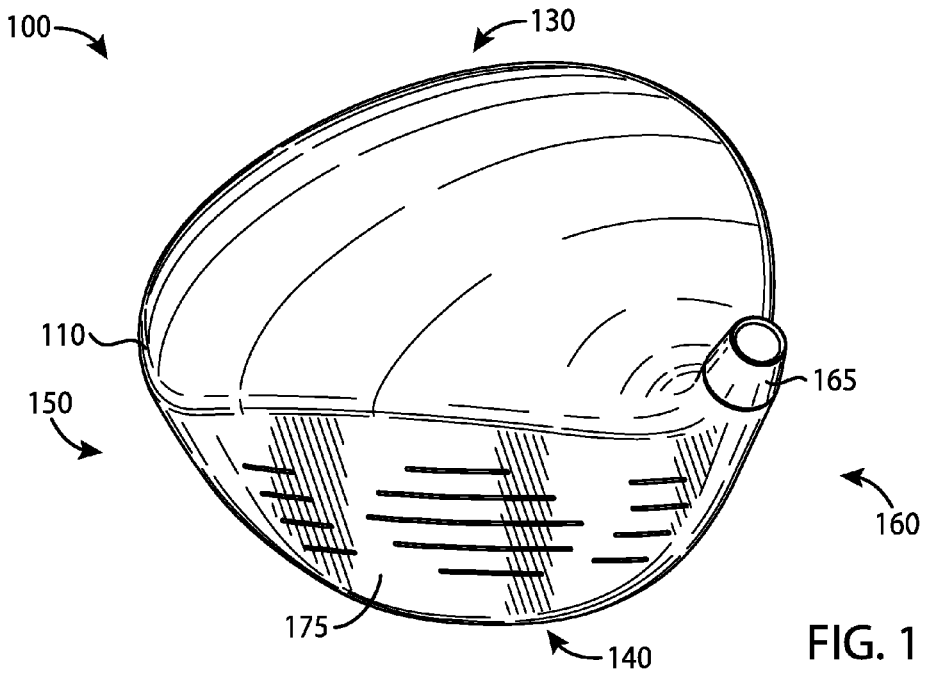
FIG. 1 is top perspective view of an example golf club head according to an embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure.

DESCRIPTION

In general, golf club heads and methods to manufacture golf club heads are described herein. The apparatus, methods, and articles of manufacture described herein are not limited in this regard.

Figure 2:
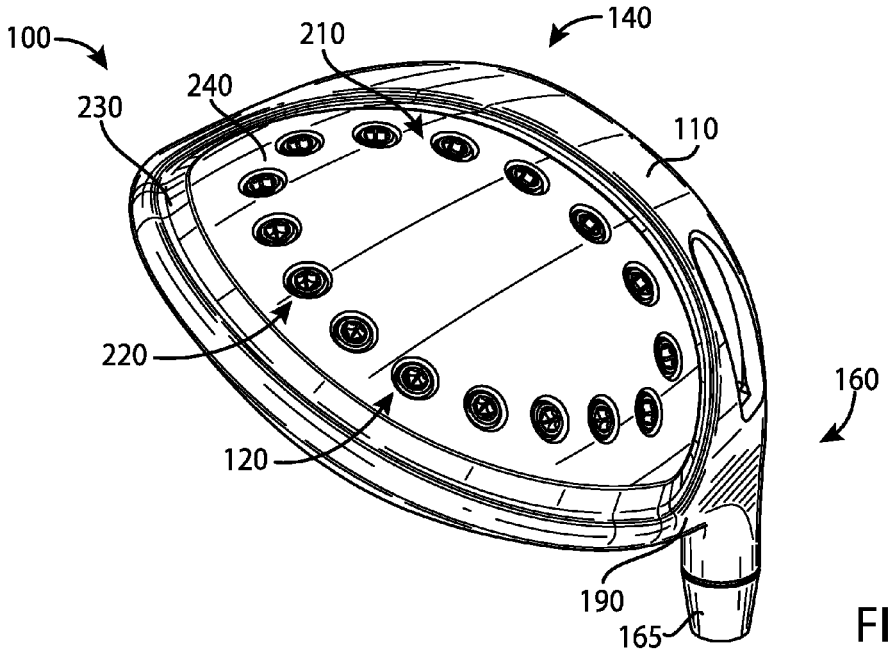
FIG. 2 depicts a bottom perspective view of the example golf club head of FIG. 1.
Figure 3:
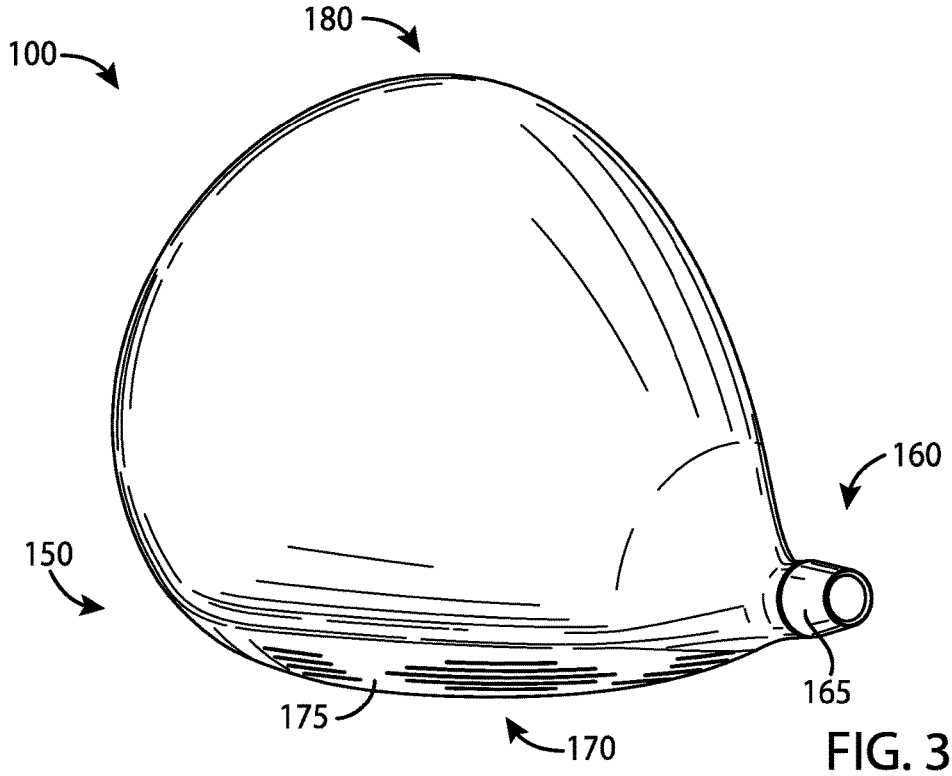
FIG. 3 depicts a top view of the example golf club head of FIG. 1.

In the example of FIGS. 1-13, a golf club head 100 may include a body portion 110, and a plurality of weight portions 120, generally, shown as a first set of weight portions 210 (FIG. 2) and a second set of weight portions 220 (FIG. 2). The body portion 110 may include a top portion 130, a bottom portion 140, a toe portion 150, a heel portion 160, a front portion 170, and a rear portion 180. The bottom portion 140 may include a skirt portion 190 defined as a side portion of the golf club head 100 between the top portion 130 and the bottom portion 140 excluding the front portion 170 and extending across a periphery of the golf club head 100 from the toe portion 150, around the rear portion 180, and to the heel portion 160. The bottom portion 140 may include a transition region 230 and a weight port region 240. For example, the weight port region 240 may be a D-shape region. The weight port region 240 may include a plurality of weight ports 900 (FIG. 9) to receive the plurality of weight portions 120. The front portion 170 may include a face portion 175 to engage a golf ball (not shown). The body portion 110 may also include a hosel portion 165 to receive a shaft (not shown). Alternatively, the body portion 110 may include a bore instead of the hosel portion 165. For example, the body portion 110 may be made partially or entirely of an aluminum-based material, a magnesium-type material, a steel-based material, a titanium-based material, any combination thereof, or any other suitable material. In another example the body portion 110 may be made partially or entirely of a non-metal material such as a ceramic material, a composite material, any combination thereof, or any other suitable material.

The golf club head 100 may have a club head volume greater than or equal to 300 cubic centimeters ($cm^3$ or cc). In one example, the golf club head 100 may be about 460 cc. Alternatively, the golf club head 100 may have a club head volume less than or equal to 300 cc. In particular, the golf club head 100 may have a club head volume between 100 cc and 200 cc. The club head volume of the golf club head 100 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 100. Although FIG. 1 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

Each of the first set of weight portions 210, generally shown as 405, 410, 415, 420, 425, 430, and 435 (FIG. 4), may be associated with a first mass. Each of the second set of weight portions 220, generally shown as 440, 445, 450, 455, 460, 465, 470, 475, and 480 (FIG. 4), may be associated with a second mass. The first mass may be greater than the second mass or vice versa. In one example, the first set of weight portions 210 may be made of a tungsten-based material whereas the second set of weight portions 220 may be made of an aluminum-based material. As described in detail below, the first and second set of weight portions 210 and 220, respectively, may provide various weight configurations (e.g., FIGS. 15-18).

Figure 9:
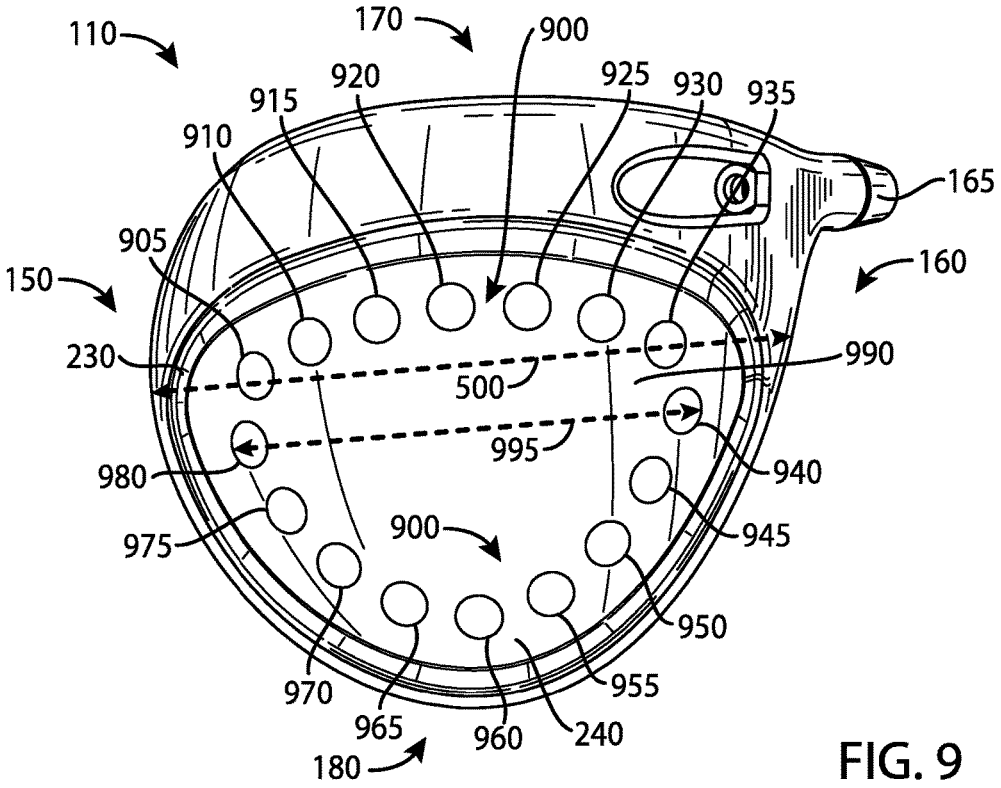
FIG. 9 depicts a bottom view of an example body portion of the example golf club head of FIG. 1.
Figure 10:
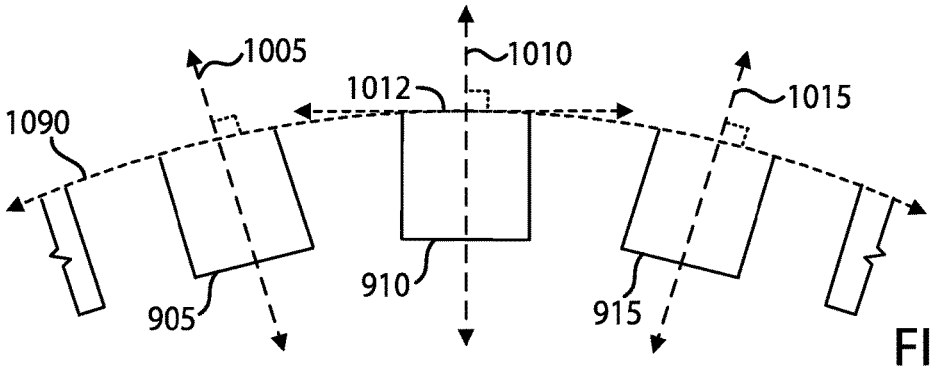
FIG. 10 depicts a cross-sectional view of the example body portion of the example golf club head of FIG. 1.
Figure 11:
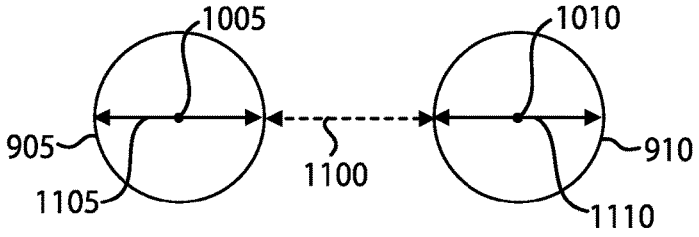
FIG. 11 depicts two weight ports of the example golf club head of FIG. 1.

Referring to FIGS. 9-11, for example, the bottom portion 140 of the body portion 110 may include a plurality of weight ports 900. The plurality of weight ports 900, generally shown as 905, 910, 915, 920, 925, 930, 935, 940, 945, 950, 955, 960, 965, 970, 975, and 980, may be located along a periphery of the weight port region 240 of the bottom portion 140. The plurality of weight ports 900 may extend across the bottom portion 140. In particular, the plurality of weight ports 900 may extend between the toe and heel portions 150 and 160, respectively, across the bottom portion 140. The plurality of weight ports 900 may also extend between the front and rear portions 170 and 180, respectively, across the bottom portion 140. The plurality of weight ports 900 may be arranged across the bottom portion 140 along a path that defines a generally D-shaped loop. In one example, the plurality of weight ports 900 may extend more than 50% of a maximum toe-to-heel distance 500 between of the toe and heel portions 150 and 160, respectively, across the bottom portion 140. The maximum toe-to-heel distance 500 of the golf club head 100 may be measured from transition regions between the top and bottom portions 130 and 140, respectively, at the toe and heel portions 150 and 160, respectively. Alternatively, the maximum toe-to-heel distance 500 may be a horizontal distance between vertical projections of the outermost points of the toe and heel portions 150 and 160, respectively. For example, the maximum toe-to-heel distance 500 may be measured when the golf club head 100 is at a lie angle 510 of about 60 degrees. If the outermost point of the heel portion 160 is not readily defined, the outermost point of the heel portion 160 may be located at a height 520 of about 0.875 inches (22.23 millimeters) above a ground plane 530 (i.e., a horizontal plane on which the golf club head 100 is lying on). In one example, the maximum toe-to-heel distance 500 may be no more than 5 inches (127 millimeters). Accordingly, the plurality of weight ports 900 may extend at least 2.5 inches between the toe and heel portions 150 and 160, respectively. A maximum toe-to-heel distance 995 of the plurality of weight ports 900 may extend between the weight ports 940 and 980. For example, the maximum toe-to-heel distance 995 of the plurality of weight ports 900 may be about 3.7 inches. As the rules of golf may change from time to time (e.g., new regulations may be adopted or old rules may be eliminated or modified by golf standard organizations and/or governing bodies), the lie angle 510 and/or the height 520 for measuring the maximum toe-to-heel distance 500 may also change. The apparatus, methods, and articles of manufacture described herein are not limited in this regard.

Each of the plurality of weight ports 900 may be associated with a port diameter ($D_{port}$) (e.g., two shown as 1105 and 1110 in FIG. 11). For example, the port diameter of each weight port of the plurality of weight ports 900 may be about 0.3 inch (7.65 millimeters). Alternatively, the port diameters of adjacent weight ports may be different. In one example, the weight port 905 may be associated with a port diameter 1105, and the weight port 910 may be associated with a port diameter 1110. In particular, the port diameter 1105 of the weight port 905 may be larger than the port diameter 1110 of the weight port 910 or vice versa. The apparatus, methods, and articles of manufacture described herein are not limited in this regard.

The bottom portion 140 may also include an outer surface 990. As illustrated in FIG. 10, for example, the plurality of weight ports 900 may be formed on the bottom portion 140 relative to an outer surface curve 1090 formed by the outer surface 990. In particular, each of the plurality of weight ports 900 may be associated with a port axis generally shown as 1005, 1010, and 1015. A center of a weight port may define the port axis of the weight port. Each port axis may be perpendicular or substantially perpendicular to a plane that is tangent to the outer surface curve 1090 at the point of intersection of the port axis and the outer surface curve 1090. In one example, substantially perpendicular may refer to a deviation of ±5° from perpendicular. In another example, substantially perpendicular may refer to a deviation of ±3° from perpendicular. The deviation from perpendicular may depend on manufacturing tolerances.

In one example, the port axis 1010 may be perpendicular or substantially perpendicular (i.e., normal) to a tangent plane 1012 of the outer surface curve 1090. Multiple fixtures may be used to manufacture the plurality of weight ports 900 by positioning the golf club head 100 in various positions. Alternatively, the weight ports may be manufactured by multiple-axis machining processes, which may be able to rotate the golf club head around multiple axes to mill away excess material (e.g., by water jet cutting and/or laser cutting) to form the plurality of weight ports 900. Further, multiple-axis machining processes may provide a suitable surface finish because the milling tool may be moved tangentially about a surface. Accordingly, the apparatus, methods, and articles of manufacture described herein may use a multiple-axis machining process to form each of the plurality of weight ports 900 on the bottom portion 140. For example, a five-axis milling machine may form the plurality of weight ports 900 so that the port axis 1000 of each of the plurality weight ports 900 may be perpendicular or substantially perpendicular to the outer surface curve 1090. The tool of the five-axis milling machine may be moved tangentially about the outer surface curve 1090 of the outer surface 990.

Turning to FIG. 11, for example, two adjacent weight ports may be separated by a port distance 1100, which may be the shortest distance between two adjacent weight ports on the outer surface 990. In particular, the port distance 1100 may be less than or equal to the port diameter of any of the two adjacent weight ports. In one example, the port distance 1100 between the weight ports 905 and 910 may be less than or equal to either the port diameter 1105 or the port diameter 1110. The apparatus, methods, and articles of manufacture described herein are not limited in this regard.

The plurality of weight portions 120 may have similar or different physical properties (e.g., density, shape, mass, volume, size, color, etc.). In one example, the first set of weight portions 210 may be a black color whereas the second set of weight portions 220 may be a gray color or a steel color. Some or all of the plurality of weight portions 120 may be partially or entirely made of a metal material such as a steel-based material, a tungsten-based material, an aluminum-based material, any combination thereof or suitable types of materials. Alternatively, some or all of the plurality of weight portions 120 may be partially or entirely made of a non-metal material (e.g., composite, plastic, etc.).

Figure 12:
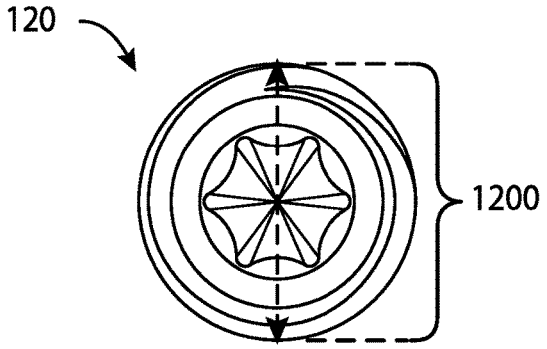
FIG. 12 depicts a top view of an example weight portion of the example golf club head of FIG. 1.
Figure 13:
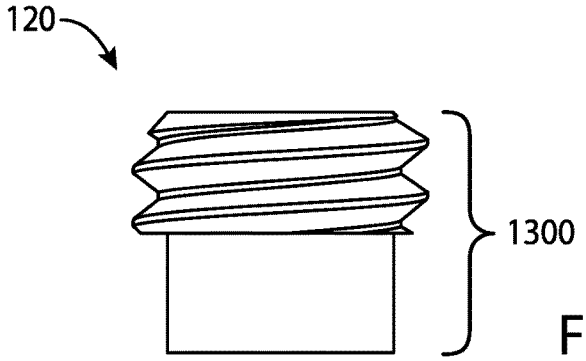
FIG. 13 depicts a side view of the example weight portion of FIG. 10.

In the illustrated example as shown in FIGS. 12 and 13, each weight portion of the plurality of weight portions 120 may have a cylindrical shape (e.g., a circular cross section). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape). Each weight portion of the plurality of weight portions 120 may be associated with a diameter 1200 and a height 1300. In one example, each weight portion of the plurality of weight portions 120 may have a diameter of about 0.3 inch (7.62 millimeters) and a height of about 0.2 inch (5.08 millimeters). Alternatively, the first and second sets of weight portions 210 and 220, respectively, may be different in width and/or height.

Instead of a rear-to-front direction as in other golf club heads, each weight portion of the plurality of weight portions 120 may engage one of the plurality of weight ports 400 in a bottom-to-top direction. The plurality of weight portions 120 may include threads to secure in the weight ports. For example, each weight portion of the plurality of weight portions 120 may be a screw. The plurality of weight portions 120 may not be readily removable from the body portion 110 with or without a tool. Alternatively, the plurality of weight portions 120 may be readily removable (e.g., with a tool) so that a relatively heavier or lighter weight portion may replace one or more of the plurality of weight portions 120. In another example, the plurality of weight portions 120 may be secured in the weight ports of the body portion 110 with epoxy or adhesive so that the plurality of weight portions 120 may not be readily removable. In yet another example, the plurality of weight portions 120 may be secured in the weight ports of the body portion 110 with both epoxy and threads so that the plurality of weight portions 120 may not be readily removable. The apparatus, methods, and articles of manufacture described herein are not limited in this regard.

Figure 14:
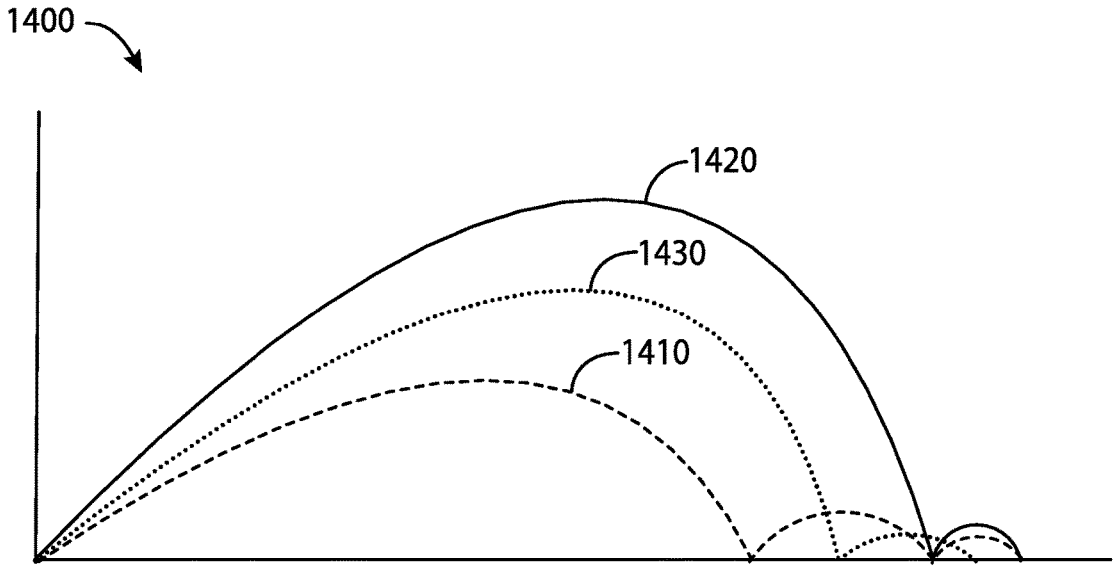
FIG. 14 depicts example launch trajectory profiles of the example golf club head of FIG. 1.
Figure 15:
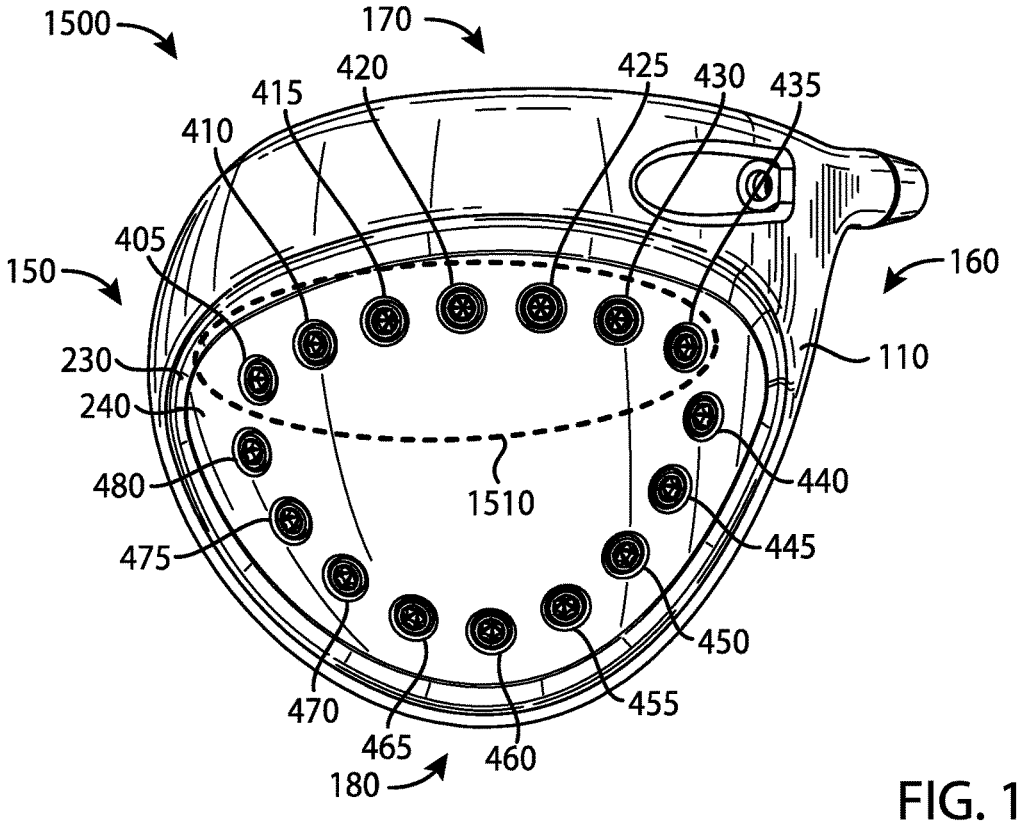
FIG. 15 depicts a first weight configuration of the example weight portions.

In contrast to other golf club heads, the golf club head 100 may accommodate at least four different types of golf swings. As illustrated in FIG. 14, for example, each weight configuration may be associated with one of the plurality of launch trajectory profiles 1400, generally shown as 1410, 1420, and 1430. Referring to FIG. 15, for example, a first weight configuration 1500 may be associated with a configuration of a first set of weight ports 1510. The first set of weight ports 1510 may be located at or proximate to the front portion 170 (e.g., weight ports 905, 910, 915, 920, 925, 930, and 935 shown in FIG. 9). In the first weight configuration 1500, a first set of weight portions may be disposed toward the front portion 170 according to the configuration of the first set of weight ports 1510, whereas a second set of weight portions may be disposed toward the rear portion 180. In particular, the first set of weight portions may form a cluster according to the configuration of the first set of weight ports 1510 at or proximate to the front portion 170. The weight portions 405, 410, 415, 420, 425, 430, and 435 may define the first set of weight portions and may be disposed in weight ports 905, 910, 915, 920, 925, 930, and 935, respectively. The weight portions 440, 445, 450, 455, 460, 465, 470, 475, and 480 may define the second set of weight portions and may be disposed in weight ports 940, 945, 950, 955, 960, 965, 970, 975, and 980, respectively. The first weight configuration 1500 may be associated with the first launch trajectory profile 1410 (FIG. 14). In particular, the first weight configuration 1500 may decrease spin rate of a golf ball. By placing relatively heavier weight portions (i.e., the first set of weight portions) towards the front portion 170 of the golf club head 100 according to the configuration of the first set of weight ports 1510, the center of gravity (GC) of the golf club head 100 may move relatively forward and lower to produce a relatively lower launch and spin trajectory. As a result, the first launch trajectory profile 1410 may be associated with a relatively greater roll distance (i.e., distance after impact with the ground). While the above example may describe the weight portions being disposed in certain weight ports, any weight portion of the first set of weight portions 210 may be disposed in any weight port of the first set of weight ports 1510.

Figure 16:
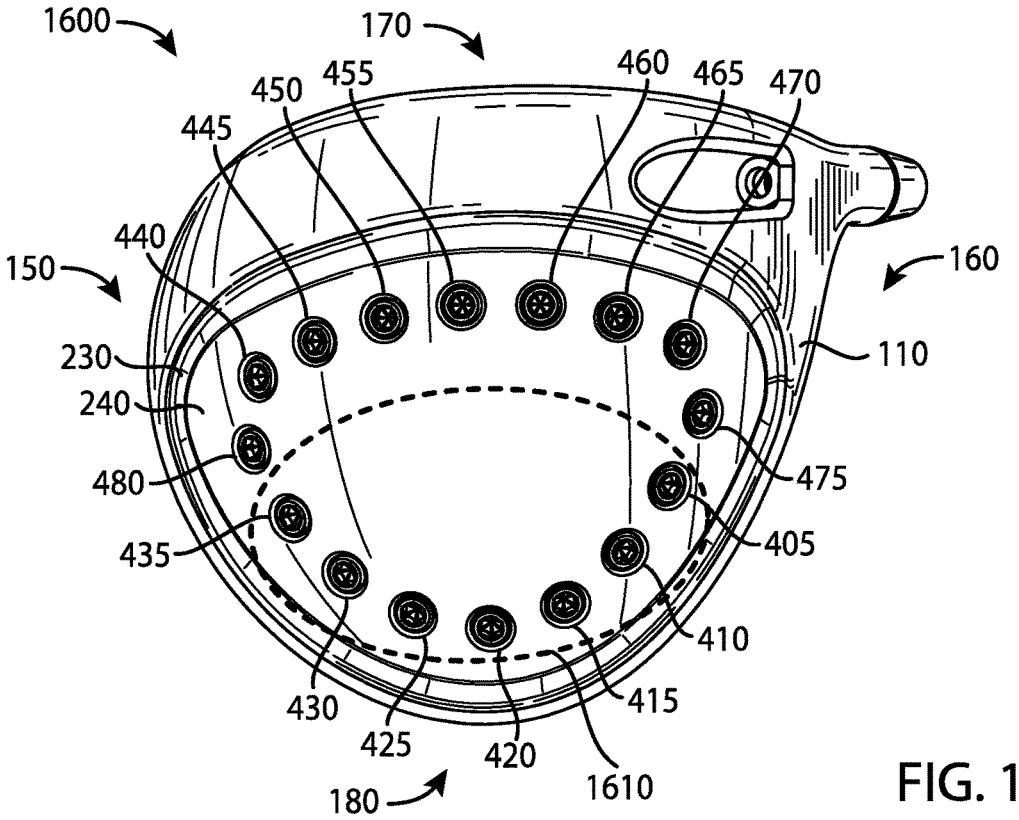
FIG. 16 depicts a second weight configuration of the example weight portions.

Turning to FIG. 16, for example, a second weight configuration 1600 may be associated with a configuration of a second set of weight ports 1610. The second set of weight ports 1610 may be located at or proximate to the rear portion 180 (e.g., weight ports, 945, 950, 955, 960, 965, 970, and 975 shown in FIG. 9). In a second weight configuration 1600 as illustrated in FIG. 16, for example, a first set of weight portions may be disposed toward the rear portion 180 whereas a second set of weight portions may be disposed toward the front portion 170. In particular, the first set of weight portions may form a cluster 1610 at or proximate to the rear portion 180 according to the configuration of the second set of weight ports 1610. The weight portions 405, 410, 415, 420, 425, 430, and 435 may define the first set of weight portions and may be disposed in weight ports 945, 950, 955, 960, 965, 970, and 975, respectively. The weight portions 440, 445, 450, 455, 460, 465, 470, 475, and 480 may define the second set of weight portions and may be disposed in weight ports 905, 910, 915, 920, 925, 930, 935, 940, and 980, respectively. The second weight configuration 1600 may be associated with the second launch trajectory profile 1420 (FIG. 14). In particular, the second weight configuration 1600 may increase launch angle of a golf ball and maximize forgiveness. By placing the relatively heavier weight portion (i.e., the first set of weight portions) towards the rear portion 180 of the golf club head 100 according to the configuration of the second set of weight ports 1610, the center of gravity (GC) of the golf club head 100 may move relatively back and up to produce a relatively higher launch and spin trajectory. Further, the moment of inertia (MOI) of the golf club head 100 may increase in both the horizontal (front-to-back axis) and vertical axes (top-to-bottom axis), which in turn, provides relatively more forgiveness on off-center hits. As a result, the second launch trajectory profile 1420 may be associated with a relatively greater carry distance (i.e., in-the-air distance).

Figure 17:
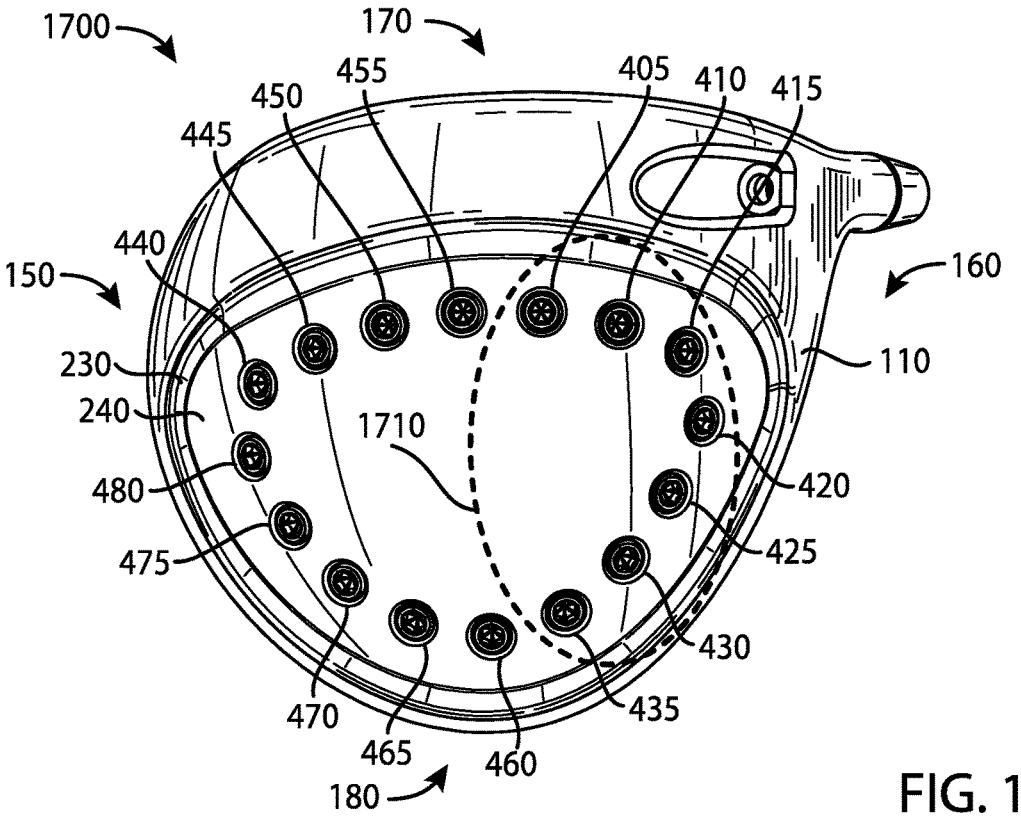
FIG. 17 depicts a third weight configuration of the example weight portions.

Turning to FIG. 17, for example, a third weight configuration 1700 may be associated with a configuration of a third set of weight ports 1710. In the third weight configuration 1700, for example, a first set of weight portions may be disposed toward the heel portion 160 whereas a second set of weight portions may be disposed toward the toe portion 150. In particular, the first set of weight portions may form a cluster of weight portions at or proximate to the heel portion 160 according to the configuration of the third set of weight ports 1710. The weight portions 405, 410, 415, 420, 425, 430, and 435 may define the first set of weight portions and may be disposed in weight ports 925, 930, 935, 940, 945, 950, and 955, respectively. The weight portions 440, 445, 450, 455, 460, 465, 470, 475, and 480 may define the second set of weight portions and may be disposed in weight ports 905, 910, 915, 920, 960, 965, 970, 975, and 980, respectively. The third weight configuration 1600 may be associated with a third launch trajectory profile 1430 (FIG. 14). In particular, the third weight configuration 1700 may allow an individual to turn over the golf club head 100 relatively easier (i.e., square up the face portion 175 to impact a golf ball). By placing the relatively heavier weight portions (i.e., the first set of weight portions) towards the heel portion 160 of the golf club head 100, the center of gravity (GC) of the golf club head 100 may move relatively closer to the axis of the shaft.

Figure 18:
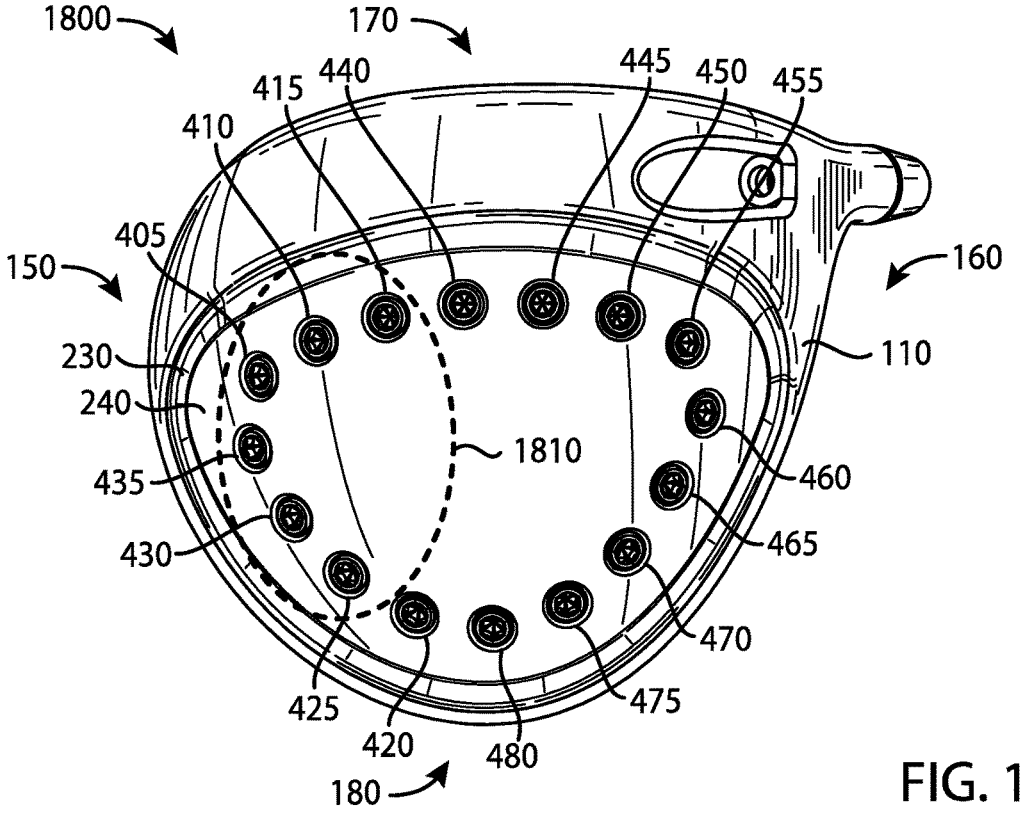
FIG. 18 depicts a fourth weight configuration of the example weight portions.
Figure 19:
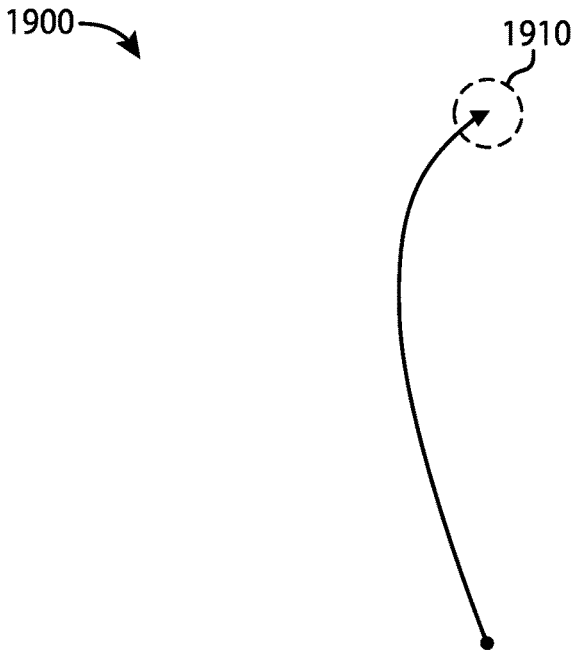
FIG. 19 depicts an example launch trajectory profile of the example golf club head of FIG. 18.

Turning to FIG. 18, for example, a fourth weight configuration 1800 may be associated with a configuration of a fourth set of weight ports 1810. In a fourth weight configuration 1800, for example, a first set of weight portions may be disposed toward the toe portion 150 whereas a second set of weight portions may be disposed toward the heel portion 160. In particular, the first set of weight portions may form a cluster of weight portions at or proximate to the toe portion 150 according to the configuration of the fourth set of weight ports 1810. The weight portions 405, 410, 415, 420, 425, 430, and 435 may define the first set of weight portions and may be disposed in weight ports 905, 910, 915, 965, 970, 975, and 980, respectively. The weight portions 440, 445, 450, 455, 460, 465, 470, 475, and 480 may define the second set of weight portions and may be disposed in weight ports 920, 925, 930, 935, 940, 945, 950, 955, and 960, respectively. The fourth weight configuration 1800 may be associated with the third launch trajectory profile 1430 (FIG. 14). In particular, the fourth weight configuration 1800 may prevent an individual from turning over the golf club head 100 (i.e., the face portion 175 may be more open to impact a golf ball). By placing the relatively heavier weight portions (i.e., the first set of weight portions) towards the toe portion 150 of the golf club head 100, the center of gravity (GC) of the golf club head 100 may move relatively farther away from the axis of the shaft. The fourth weight configuration 1800 may result in a fade golf shot (as shown in FIG. 19, for example, a trajectory or ball flight in which a golf ball travels to the left of a target 1910 and curving back to the right of the target for a right-handed individual). The apparatus, methods, and articles of manufacture described herein are not limited in this regard.

Figure 20:
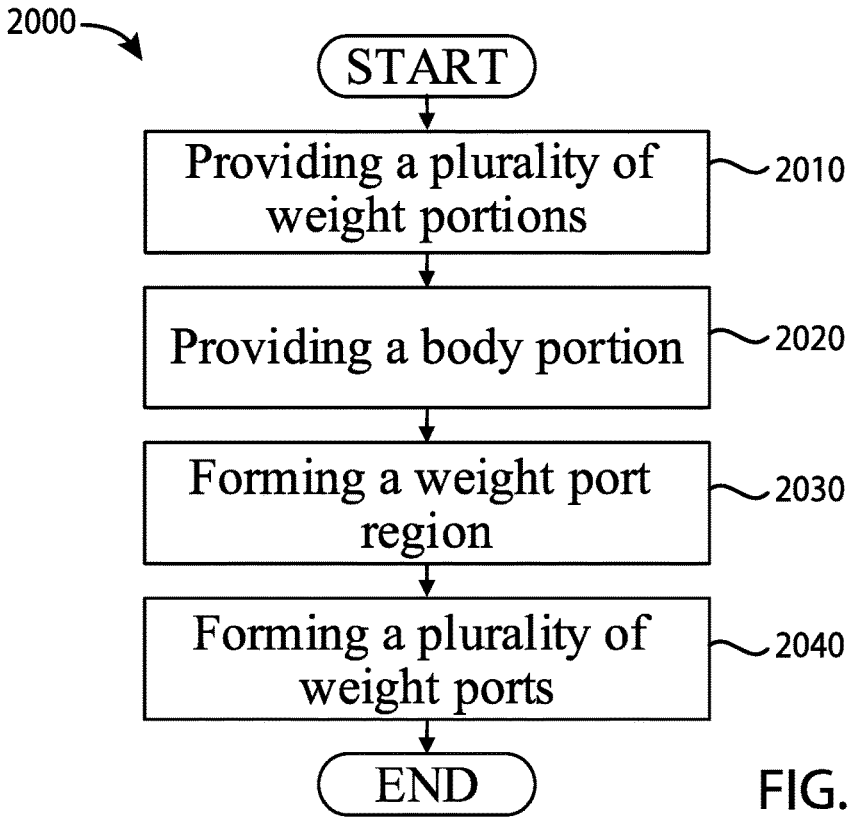
FIG. 20 depicts one manner in which the example golf club heads described herein may be manufactured.

FIG. 20 depicts one manner in which the golf club head 100 may be manufactured. In the example of FIG. 20, the process 2000 may begin with providing a plurality of weight portions (block 2010). The plurality of weight portions may include a first set of weight portions and a second set of weight portions. Each weight portion of the first set of weight portions may be associated with a first mass whereas each weight portion of the second set of weight portions may be associated with a second mass. The first mass may be greater than the second mass. In one example, each weight portion of the first set of weight portions may be made of a tungsten-based material with a mass 2.6 grams whereas each weight portion of the second set of weight portions may be made of an aluminum-based material with a mass of 0.4 grams. The first set of weight portions may have a gray color or a steel color whereas the second set of weight portions may have a black color.

The process 2000 may provide a body portion of a golf club head (block 2020). The body portion may include a front portion, a rear portion, a toe portion, a heel portion, a top portion, a bottom portion having an outer surface associated with outer surface curve, and a skirt portion between the top and bottom portion.

The process 2000 may form a weight port region located at or proximate to the bottom and skirts portions (block 2030). A transition region may surround the weight port region.

The process 2000 may form a plurality of weight ports along a periphery of the weight port region (block 2040). Each weight port of the plurality of weight ports may be associated with a port diameter and configured to receive at least one weight portion of the plurality of weight portions. Two adjacent weight ports may be separated by less than or equal to the port diameter. Further, each weight port of the plurality of weight ports may be associated with a port axis. The port axis may be perpendicular or substantially perpendicular relative to a tangent plane of the outer surface curve of the bottom portion of the golf club head.

The example process 2000 of FIG. 20 is merely provided and described in conjunction with FIGS. 1-19 as an example of one way to manufacture the golf club head 100. While a particular order of actions is illustrated in FIG. 20, these actions may be performed in other temporal sequences. For example, two or more actions depicted in FIG. 20 may be performed sequentially, concurrently, or simultaneously. Although FIG. 20 depicts a particular number of blocks, the process may not perform one or more blocks. The apparatus, methods, and articles of manufacture described herein are not limited in this regard.

Figure 4:
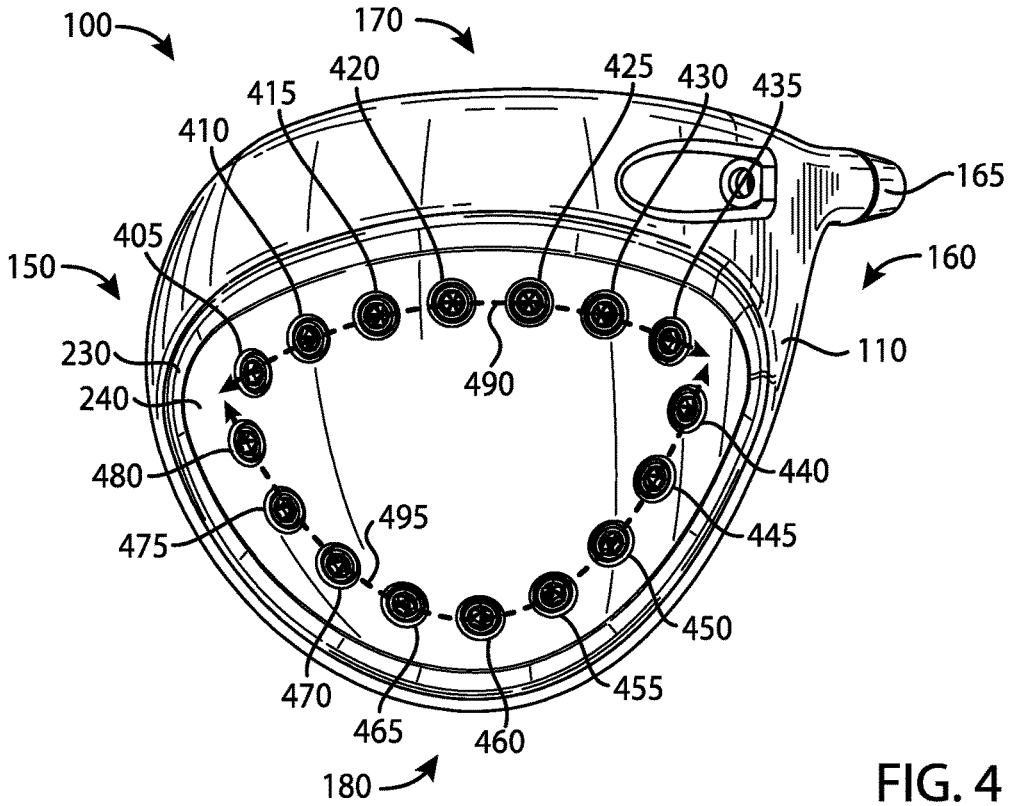
FIG. 4 depicts a bottom view of the example golf club head of FIG. 1.
Figure 5:
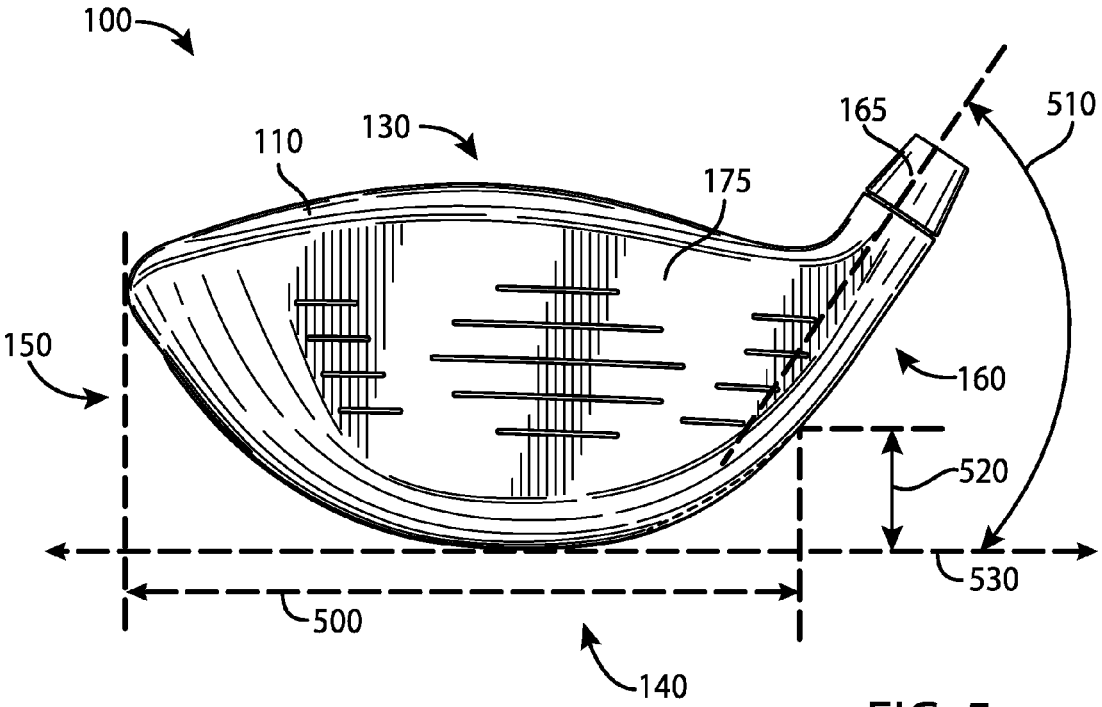
FIG. 5 depicts a front view of the example golf club head of FIG. 1.
Figure 6:
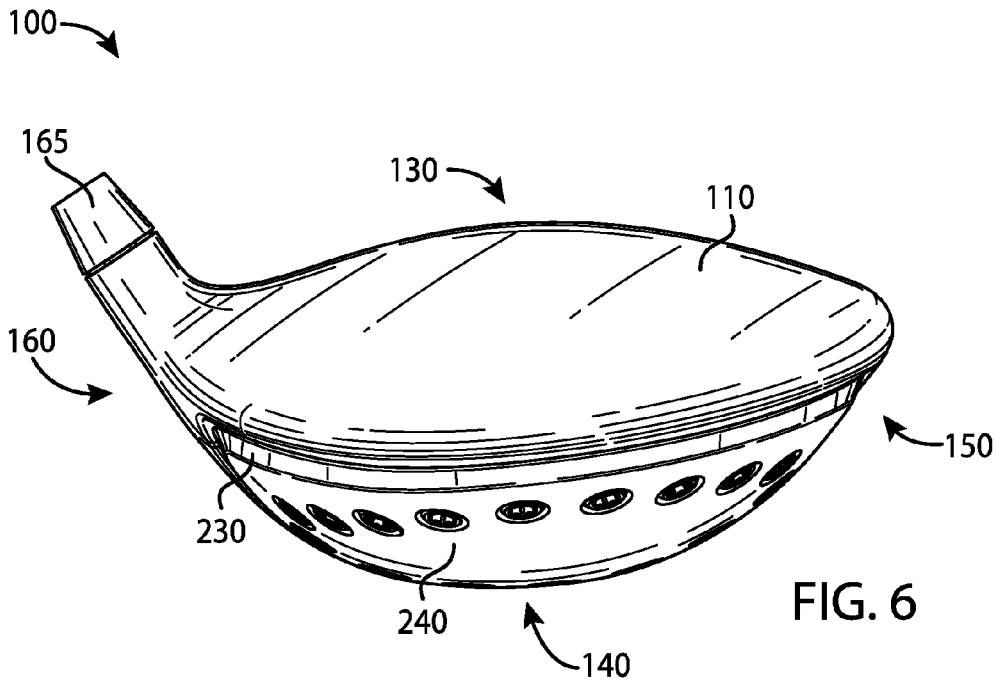
FIG. 6 depicts a rear view of the example golf club head of FIG. 1.
Figure 7:
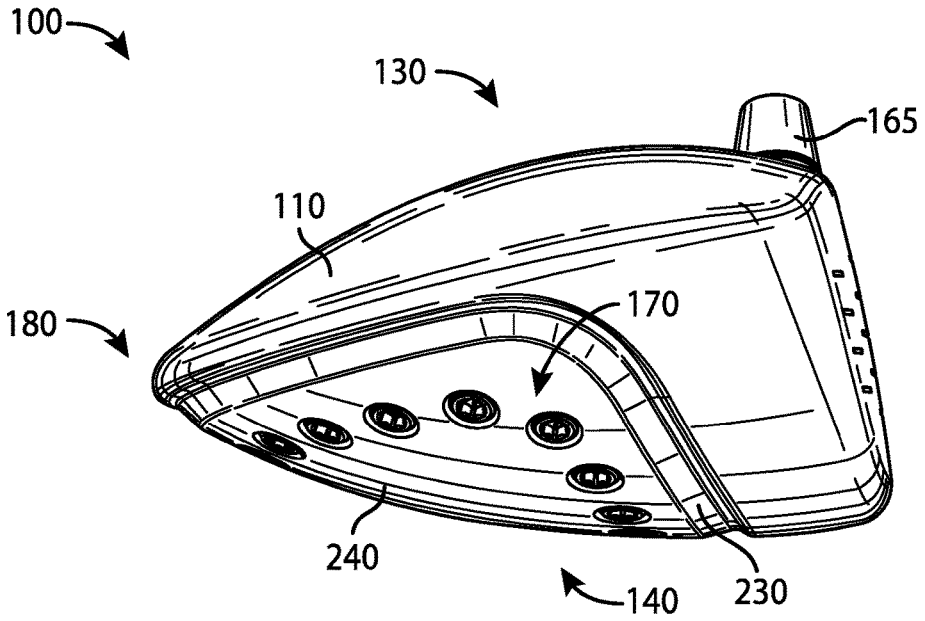
FIG. 7 depicts a toe view of the example golf club head of FIG. 1.
Figure 8:
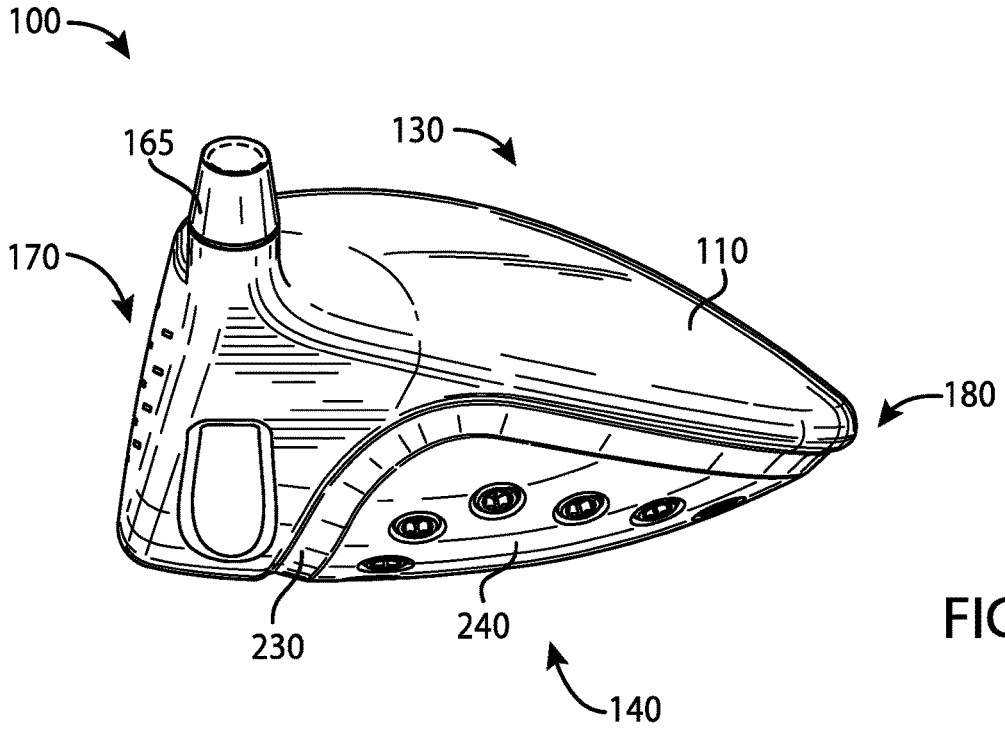
FIG. 8 depicts a heel view of the example golf club head of FIG. 1.

As shown in the above examples, the plurality of weight portions 120 and the plurality of weight ports 900 may be located on a periphery of the weight port region 240 along a path that defines a generally D-shaped loop formed with two arcs, generally shown as 490 and 495 in FIG. 4. For example, the weight portions 405, 410, 415, 420, 425, 430, and 435 (FIG. 4), and the weight ports 905, 910, 915, 920, 925, 930, and 935 (FIG. 9) may form the first arc 490. In particular, the first arc 490 may extend between the toe and heel portions 150 and 160, respectively, across the bottom portion 140. The weight portions 440, 445, 450, 455, 460, 465, 470, 475, and 480 (FIG. 4), the weight ports 940, 945, 950, 955, 960, 965, 970, 975, and 980 (FIG. 9) may form the second arc 495. The second arc 495 may generally follow the contour of the rear portion 180 of the body portion 110. Alternatively, the first and second arcs 490 and 495 may define loops with other shapes that extend across the bottom portion 140 (e.g., a generally O-shaped loop). The apparatus, methods, and articles of manufacture described herein are not limited in this regard.

Figure 21:
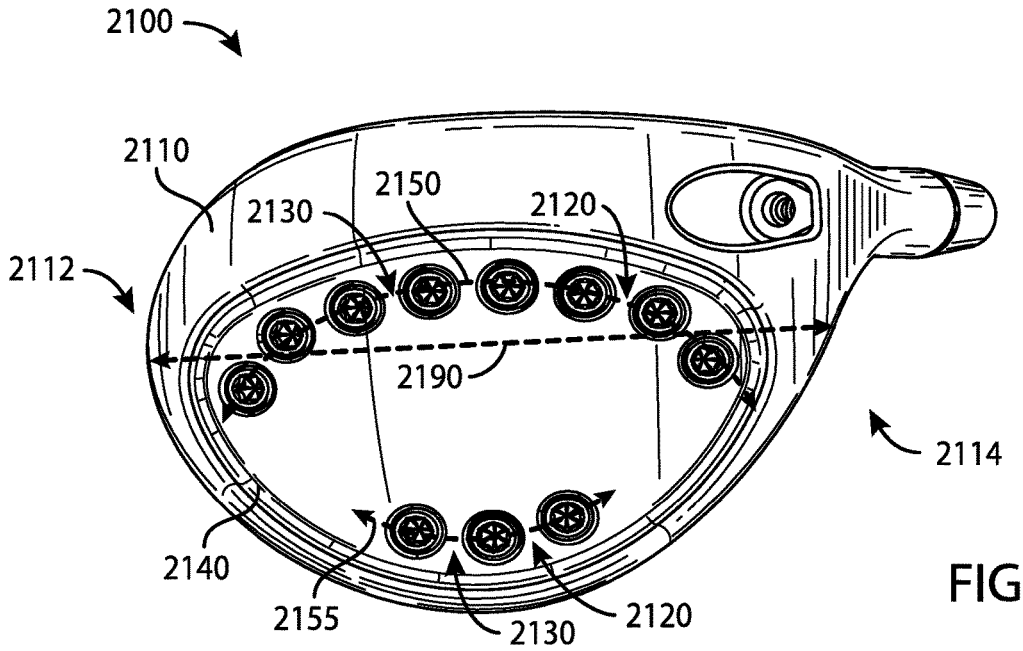
FIG. 21 depicts a bottom view of another example golf club head.

Although the above examples may depict the plurality of weight portions 120 and the plurality of weight ports 900 forming a particular geometric shape, the apparatus, methods, and articles of manufacture described herein may have weight portions and weight ports located along a periphery of a weight portion region to form other geometric shapes. Turning to FIG. 21, for example, a golf club head 2100 may include a bottom portion 2110, and a plurality of weight portions 2120 disposed in a plurality of weight ports 2130. The plurality of weight ports 2130 may be located along a periphery of a weight port region 2140 of the bottom portion 2110 (i.e., the plurality of weight ports 2130 may extend between the toe and heel portions 2112 and 2114, respectively, across the bottom portion 2110). In contrast to the plurality of weight portions 120 and the plurality of weight ports 900 (e.g., FIGS. 4 and 9), the plurality of weight ports 2130 may form two discrete arcs, generally shown as 2150 and 2155, extending across the bottom portion 2110. The plurality of weight ports 2130 may extend more than 50% of a maximum toe-to-heel distance 2190 of the golf club head 2100. The apparatus, methods, and articles of manufacture are not limited in this regard.

Figure 22:
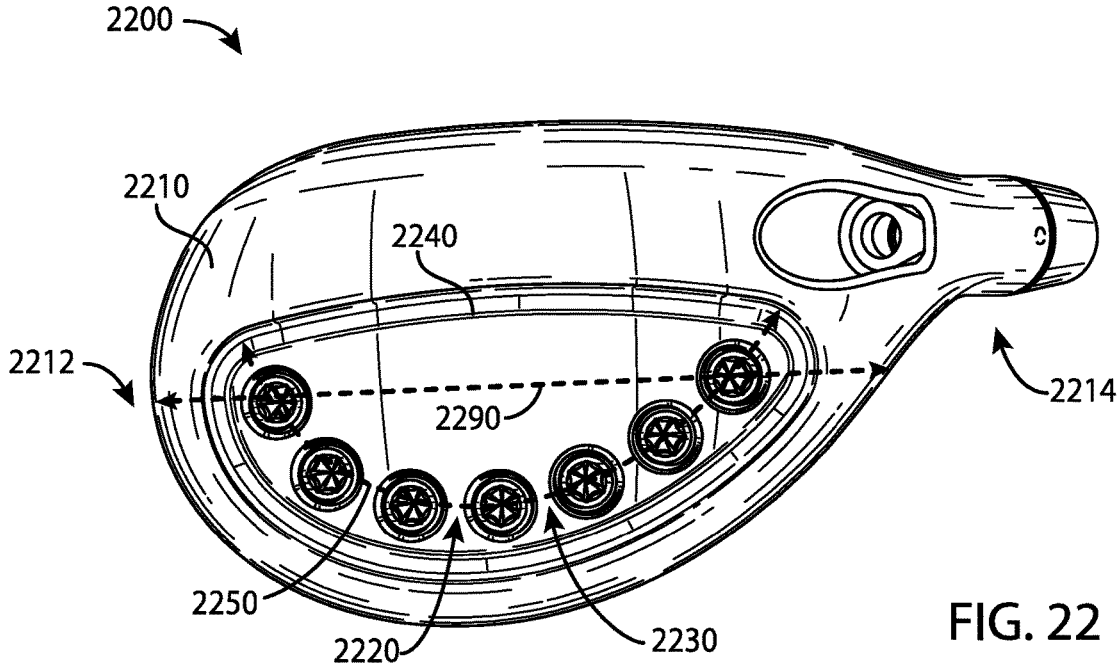
FIG. 22 depicts a bottom view of yet another example golf club head.

As illustrated in FIG. 22, for example, a golf club head 2200 may include a bottom portion 2210, and a plurality of weight portions 2220 disposed in a plurality of weight ports 2230. The plurality of weight ports 2230 located along a periphery of a weight port region 2240 may be arranged along a path that defines an arc, generally shown as 2250, extending across the bottom portion 2210 (i.e., the plurality of weight ports 2230 may extend between the toe and heel portions, 2212 and 2214 across the bottom portion 2210). The plurality of weight ports 2230 may extend more than 50% of a maximum toe-to-heel distance 2290 of the golf club head 2200. The apparatus, methods, and articles of manufacture are not limited in this regard.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion having a front portion, a rear portion, a toe portion, a heel portion, a top portion, a bottom portion, a skirt portion between the top portion and the bottom portion; and a port region located at or proximate to the bottom portion and the skirt portion, the port region defined by a continuous curved outer surface portion of the bottom portion, the port region having a plurality of ports, each port of the plurality of ports having an opening on the continuous curved outer surface portion, the plurality of ports comprising:

a first set of ports being closer to the front portion than the rear portion and extending between the toe portion and the heel portion;

a second set of ports being closer to the rear portion than the front portion and extending between the toe portion and the heel portion;

a third set of ports being closer to the toe portion than the heel portion and extending between the front portion and the rear portion, and a fourth set of ports being closer to the heel portion than the toe portion and extending between the front portion and the rear portion.

2. A driver-type golf club head as defined in claim 1, wherein each port of the plurality of ports is associated with a port diameter and a port axis perpendicular or substantially perpendicular to the curved outer surface portion.

3. A golf club head as defined in claim 1 further comprising a plurality of weight portions having a first set of weight portions with each weight portion of the first set being associated with a first mass, and a second set of weight portions with each weight portion of the second set being associated with a second mass different than the first mass, wherein the first set of weight portions are associated with at least three ports of the first set of ports, and wherein the second set of weight portions are associated with at least three ports of the second set of ports.

4. A golf club head as defined in claim 1 further comprising a plurality of weight portions having a first set of weight portions with each weight portion of the first set being associated with a first mass, and a second set of weight portions with each weight portion of the second set being associated with a second mass different than the first mass, wherein the first set of weight portions are associated with at least three ports of the third set of ports, and wherein the second set of weight portions are associated with at least three ports of the fourth set of ports.

5. A golf club head as defined in claim 1, wherein each pair of adjacent ports of the plurality of ports is separated by less than or equal to the port diameter of any port of the pair of adjacent ports.

6. A golf club head as defined in claim 1, wherein the plurality ports extends along substantially an entire periphery of the port region in a substantially similarly spaced apart configuration to define a continuous loop of ports.

7. A golf club head comprising:

a body portion having a front portion, a rear portion, a toe portion, a heel portion, a top portion, and a bottom portion; and a port region located at or proximate to the bottom portion, the port region having a plurality of ports along a periphery of the port region, each port having an opening on an outer surface of the bottom portion and extending from the opening into the body portion toward the top portion, the plurality of ports comprising:

a first set of ports located closer to the toe portion than the heel portion, at least one of the ports of the first set of ports being closer to the front portion than the rear portion and at least one of the ports of the first set of ports being closer to the rear portion than the front portion, and a second set of ports located closer to the heel portion than the toe portion, at least one of the ports of the second set of ports being closer to the front portion than the rear portion and at least one of the ports of the second set of ports being closer to the rear portion than the front portion.

8. A golf club head as defined in claim 7, further comprising a third set of ports located closer to the front portion than the rear portion, wherein the third set of ports extends more than 50% of a maximum distance between the toe portion and the heel portion across the bottom portion.

9. A golf club head as defined in claim 7, further comprising a fourth set of ports located closer to the rear portion than the front portion, wherein the fourth set of ports extends more than 50% of a maximum distance between the toe portion and the heel portion across the bottom portion.

10. A golf club head as defined in claim 7 further comprising a plurality of weight portions, wherein the first set of ports is associated with a first set of weight portions of the plurality of weight portions, wherein the second set of ports is associated with a second set of weight portions of the plurality of weight portions, and wherein the second set of weight portions has a greater mass than the first set of weight portions.

11. A golf club head as defined in claim 7 further comprising a plurality of weight portions, wherein the first set of ports is associated with a first set of weight portions of the plurality of weight portions, wherein the second set of ports is associated with a second set of weight portions of the plurality of weight portions, and wherein the first set of weight portions has a greater mass than the second set of weight portions.

12. A golf club head as defined in claim 7 further comprising:

a third set of ports located closer to the front portion than the rear portion;

a fourth set of ports located closer to the rear portion than the front portion;

a plurality of weight portions;

wherein the third set of ports is associated with a first set of weight portions of the plurality of weight portions;

wherein the fourth set of ports is associated with a second set of weight portions of the plurality of weight portions, and wherein the second set of weight portions has a greater mass than the first set of weight portions.

13. A golf club head as defined in claim 7 further comprising:

a third set of ports located closer to the front portion than the rear portion;

a fourth set of ports located closer to the rear portion than the front portion;

a plurality of weight portions;

wherein the third set of ports is associated with a first set of weight portions of the plurality of weight portions;

wherein the fourth set of ports is associated with a second set of weight portions of the plurality of weight portions, and wherein the first set of weight portions has a greater mass than the second set of weight portions.

14. A golf club head as defined in claim 7 further wherein the bottom portion includes an outer surface associated with an outer surface curve, and wherein each port of the plurality of ports includes an opening on the curved outer surface of the weight port region and each port of the plurality of ports is associated with a port diameter and a port axis perpendicular or substantially perpendicular to the curved outer surface.

15. A golf club head comprising:

a body portion having a front portion, a rear portion, a toe portion, a heel portion, a top portion, and a bottom portion; and a plurality of weight portions on the bottom portion, each weight portion being visible when the body portion is viewed from the bottom portion, the plurality of weight portions comprising:

a first set of weight portions having at least three weight portions located closer to the front portion than the rear portion and extending along a curved path on the bottom portion, the at least three weight portions of the first set of weight portions being substantially similarly spaced apart, and a second set of weight portions having at least three weight portions located closer to the rear portion than the front portion and extending along a curved path on the bottom portion, the at least three adjacent weight portions of the second set of weight portions being substantially similarly spaced apart.

16. A golf club head as defined in claim 15, wherein the first set of weight portions extends more than 50% of a maximum distance between the toe portion and the heel portion across the bottom portion, and wherein the second set of weight portions extends more than 50% of a maximum distance between the toe portion and the heel portion across the bottom portion.

17. A golf club head as defined in claim 15 wherein the second set of weight portions has a greater mass than the first set of weight portions.

18. A golf club head as defined in claim 15 wherein the first set of weight portions has a greater mass than the second set of weight portions.

19. A golf club head as defined in claim 15 further comprising a plurality of ports located on the bottom portion, each port of the plurality of ports configured to receive a weight portion of the plurality of weight portions.

20. A golf club head as defined in claim 15, wherein the bottom portion includes a curved outer surface portion associated with an outer surface curve and a plurality of ports, wherein each port of the plurality of ports includes an opening on the curved outer surface portion, wherein each port of the plurality of ports is configured to receive a weight portion of the plurality of weight portions, and wherein each port of the plurality of ports is associated with a port diameter and a port axis perpendicular or substantially perpendicular to the curved outer surface.

* * * * *